United States Patent [19]

Aida et al.

[11] Patent Number: 4,604,146

[45] Date of Patent: Aug. 5, 1986

[54] PROCESS FOR MANUFACTURING HIGH TENSILE STEEL WIRE

[75] Inventors: Akira Aida, Kitakyushu; Tetsu Ohno, Nishinomiya; Takashi Fukuda; Kenji Aihara, both of Kitakyushu; Takuo Mizoguchi, Yukuhashi; Syozi Nishimura; Katsuyoshi Kajiyama, both of Kitakyushu, all of Japan

[73] Assignee: Sumitomo Metal Industries, Ltd., Osaka, Japan

[21] Appl. No.: 563,322

[22] Filed: Nov. 7, 1983

Related U.S. Application Data

[63] Continuation of Ser. No. 319,070, Nov. 6, 1981, abandoned.

[30] Foreign Application Priority Data

Nov. 8, 1980 [JP] Japan ..... 55-157276
Sep. 2, 1981 [JP] Japan ..... 56-139187

[51] Int. Cl.[4] ..... C21D 9/52
[52] U.S. Cl. ..... 148/12 B; 148/12.4
[58] Field of Search ..... 148/12 B, 12.4

[56] References Cited

U.S. PATENT DOCUMENTS 2,924,543 2/1960 Nachtman ..... 148/12 B
3,926,687 12/1975 Gordo et al. ..... 148/12 B
4,016,009 4/1977 Economopolous et al. ..... 148/12 B
4,242,153 12/1980 Vitelli et al. ..... 148/12 B

FOREIGN PATENT DOCUMENTS 2238768 2/1975 France ..... 148/12 B
89817 8/1978 Japan ..... 148/12 B
119134 9/1980 Japan ..... 148/12 B

OTHER PUBLICATIONS

Iron Age, "Steel Bars Climb to 400,000 Psi", Feb. 7, 1963, pp. 85–87.

*Primary Examiner*—Wayland Stallard
*Attorney, Agent, or Firm*—Burns, Doane, Swecker and Mathis

[57] ABSTRACT

A process for manufacturing a high tensile steel wire, characterized by comprising the steps of pre-cooling a hot-rolled steel rod to a temperature between 750°–900° C. by means of a cooling apparatus provided between a group of intermediate rolling mills and a group of finishing rolling mills in a hot rolling line for steel rod, finishing rolling the thus pre-cooled steel rod, quenching the hot rolled steel rod to a temperature of 700° C. or lower to provide a supercooled austenite phase, then finishing-cooling the thus quenched rod to provide martensite, and drawing the resulting steel rod with roller dies without descaling is disclosed.

8 Claims, No Drawings

PROCESS FOR MANUFACTURING HIGH TENSILE STEEL WIRE

This application is a continuation of application Ser. No. 319,070, filed Nov. 6, 1981 now abandoned.

BACKGROUND OF THE INVENTION

This invention is directed to a process for manufacturing a high tensile steel rod or wire (hereunder referred to as "wire" collectively).

In the prior art, prestressed concrete wires (hereunder "PC wires") such as those in the grade of SBPR 110/135 and SBPD 130/145 of JIS G-3109 have been manufactured by descaling a hot-rolled rod mechanically or chemically (pickling), applying lime water or chemical treatment to the surface of the rod so as to prepare a lubricating surface, drawing the resulting rod, then, if necessary, deforming, and heat treating, i.e. quenching and tempering the resulting wire in a separate production line. However, in the prior art the productivity is very low, because one specialized apparatus is employed only for carrying out descaling and because many different steps, such as rolling, descaling, drawing, deforming and heat treating have to be applied separately and discontinuously. Descaling which should be applied prior to drawing has been thought indispensable to provide a wire of high quality and to prevent damage to the drawing dies. However, the use of pickling to effect descaling brings the problem of waste water treatment with resultant increase in manufacturing cost. If mechanical descaling is carried out by means of, for example, a roll bender, manufacturing cost is inevitably increased due to its high initial cost.

In general, the amount of scale which is formed at a high temperature depends on the initial heating temperature and the cooling rate of the material. The higher the initial heating temperature and the slower the cooling rate, the more scale is formed during cooling.

As is well known in the art, according to the conventional STELMOR type cooling system, in which a loop-coil extended along a conveyor is cooled by blowing air, since the initial heating temperature (the temperature at the inlet of the conveyor) is rather high, the rod which retains much austenite is discharged from the conveyor and coiled with a coiler. Therefore, the cooling rate of the coiled wire becomes lower than the critical cooling rate, causing the formation of a banite phase. In addition, since the rod is cooled from a relatively high temperature at a relatively low cooling rate by blowing air, formation of much scale is inevitable, making it impossible to effect roller die drawing without descaling.

It is necessary to form a ductile scale predominantly comprised to FeO in order to effect the wire drawing without descaling. However, it is difficult to form such ductile scale by the conventional method.

An object of this invention is to provide a process for manufacturing a high tensile steel wire of excellent quality in a highly efficient way at a low cost, eliminating such prior art disadvantages as mentioned above.

Another object of this invention is to provide a process for continuously manufacturing a high tensile steel wire of excellent quality through the STELMOR type cooling system.

The "high tensile steel wire" of this invention includes a wire or rod mainly used as PC concrete wire having a round or deformed section.

The inventors of this invention have proposed a process for manufacturing a high tensile steel wire, which comprises quenching a hot-rolled steel rod in a single stage to provide martensite, and then without application of descaling, drawing the resulting rod with roller dies (See Japanese Patent Application No. 56656/1979—Japanese Laid-Open Specification No. 147416/1980).

The inventors of this invention have now found that the scale formed during hot-rolling does not adversely affect the succeeding roller die drawing when the hot-rolled rod is pre-cooled prior to the finishing rolling and after finishing rolling the rod is quenched to a temperature of 700° C. or lower, followed by finishing cooling to form martensite. The product wire which has been subjected to wire drawing and further shaping without application of descaling has a bright and smooth surface which does not impair the value of the product.

In order to form martensite, it is necessary to cool the wire at a rate higher than the critical cooling rate. The purpose of forming martensite in that way mentioned above is not only to obtain predetermined mechanical properties, but also to have surface scale which does not adversely affect the succeeding wire drawing.

The inventors of this invention have also found that when the hot-rolled rod is pre-cooled prior to the finishing rolling, then after finishing rolling, the rod is quenched to a temperature of 700° C. or lower, preferably to a temperature between 700°-500° C. by means of forced cooling, such as water quenching, the cooling carried out by means of blowing air with the conventional STELMOR type cooling apparatus can achieve a sufficient degree of formation of martensite before the rod is coiled. And unexpectedly, as is disclosed in the working examples hereinafter, the very small grain size of the thus obtained martensite eliminates fluctuation in ductility of the resulting rod. In addition, since the thus formed surface scale is very thin, it is possible to effect wire drawing without application of descaling.

In summary, the essence of this invention resides in a process for manufacturing a high tensile steel wire, characterized by comprising the steps of pre-cooling a hot-rolled steel rod to a temperature between 750°-900° C. by means of a cooling apparatus provided between a group of intermediate rolling mills and a group of finishing rolling mills in a hot-rolling line for steel rod, finishing rolling the thus pre-cooled steel rod, quenching the hot rolled steel rod to a temperature of 700° C. or lower to provide a supercooled austenite phase; then finishing-cooling the thus quenched rod to provide martensite, and drawing the resulting steel rod with roller dies without application of descaling.

After wire drawing, deforming may be applied to provide a deformed wire. Tempering and warm straightening may also be applied to the resulting wire after the drawing or deforming.

In one embodiment, the steel wire of this invention comprises:

C: 0.10-0.40%;
Si: 0.05-1.50%,
Mn: 0.70-2.50%;
Cr: 0.10-1.50%;
at least one of Mo: 0.05-0.50% and B: 0.0002-0.0050%,
and the balance iron and incidental impurities.

In another embodiment, the steel wire of this invention comprises:

C: 0.10-0.40%;

Si: 0.05–1.50%;
Mn: 0.70–2.50%;
Cr: 0.10–1.50%;
B: 0.0002–0.0050%;
at least one of Ti: 0.0050–0.050% and Al: 0.007–0.050%, and the balance iron and incidental impurities.

According to this invention, therefore, a cooling apparatus is provided between a group of intermediate rolling mills and a group of finishing rolling mills in a hot-rolling line for the production of a steel rod, so that a hot-rolled rod may be pre-cooled to a temperature between 750°–900° C. prior to the finishing rolling and then the pre-cooled rod is rolled to a predetermined size through the group of finishing rolling mills. After finishing rolling, the resulting hot-rolled rod is quenched to a temperature of 700° C. or lower to render a supercooled austenite phase having very fine grains. The thus obtained supercooled austenite may successfully be transformed to a martensite by cooling it even at a relatively low rate. The thus obtained martensite steel rod may be subjected to roller die drawing without application of descaling.

The purpose of applying the pre-cooling between the intermediate and finishing rollings is to eliminate the fluctuation in finishing temperature caused by fluctuation in heating temperature of the work piece and also to restrict the finishing rolling temperature to a temperature as low as possible so that fine and uniform austenitic grains may be obtained when quenched in a succeeding stage. Thus, according to this invention, prior to the finishing rolling, the resulting hot-rolled rod is cooled to a predetermined temperature between 750°–900° C. by controlling the amount of cooling water, for example, depending on the inlet temperature of hot rolling mills or initial rolling temperature. When the temperature is lower than 750° C., the temperature of the surface of the rod is sometimes chilled to the transformation temperature, causing the transformation to martensite. On the other hand, when the temperature is higher than 900° C., the austenitic grains may recrystallize or grow to provide non-uniformly dispersed grains of different sizes.

After finishing rolling at a predetermined temperature in the range of 750°–900° C., the resulting hot-rolled rod is quenched to a temperature of 700° C. or lower. It is necessary to quench the hot-rolled rod to 700 or lower prior to finishing cooling so as to allow the rod to be cooled at a cooling rate higher than the critical cooling rate in the succeeding finishing cooling even if a slow cooling rate is used in the succeeding finishing cooling stage.

According to this invention, since the supercooled austenite at a temperature of 700 or lower is finishing-cooled to provide martensite directly without need of employing an additional step to heat the rod before finishing cooling, this invention is advantageous from the viewpoint of thermal efficiency. In addition, the surface scale formed during finishing cooling according to this invention does not have any adverse effects on the succeeding roller die drawing. This is one of the great advantages of this invention.

Roller dies for use in wire drawing were known in the art. However, it is quite difficult to produce a wire of high quality without application of descaling prior to the wire drawing with these roller dies, as long as the wire is prepared by the conventional process. However, according to this invention, it is possible to apply the roller die drawing directly to the thus obtained rod having a martensitic structure with a thin and ductile surface scale.

The thus obtained martensitic steel rod may be transported directly to the wire drawing stage without application of descaling. One of the features of this invention is that the wire drawing is carried out by means of roller dies. That is, the drawing is carried out by reducing the section of the rod through a series of V-H rollers. For the first time it is possible to eliminate the step of descaling by the combination of the roller-die drawing with the above defined martensitic steel rod. The elimination of the descaling step may bring about a remarkable reduction in costs—equipment, raw material, labour, etc.

The steel wire the diameter of which has been reduced to a predetermined size through roller dies may be transported directly to a tempering stage. Usually it is necessary to apply heat treatment including quenching and tempering in order to provide a high tensile PC steel wire. However, according to this invention, since the martensite structure has been formed through the finishing cooling as mentioned hereinbefore, the only heat treatment to be applied after wire drawing or deforming is tempering. Prior to tempering, the tensile strength of the wire is at the level required for a PC wire, but its yield point is low. Therefore, tempering is necessary to improve the yield point. The heating for tempering is preferably carried out by employing a high frequency induction heating system.

The PC steel wire is usually required to exhibit straightness and resistance to relaxation (especially resistance to warm relaxation at a temperature of about 180° C.). In a preferred embodiment warm straightening may be applied to provide such properties as mentioned above at any time during the tempering stage. The warm straightening is also effective to improve the resistance to relaxation. Thus, straightening as well as improvement in relaxation-resistant properties may be achieved simultaneously by effecting the warm straightening. According to this invention, since the heat contained in the steel wire may be utilized in carrying out the warm straightening, the process of this invention is advantageous from the viewpoint of thermal economy.

A preferred steel composition which may successfully be processed in accordance with this invention is:
C: 0.10–0.40%; Si: 0.05–1.50%;
Mn: 0.70–2.50%; Cr: 0.10–1.50%;
at least one of Mo: 0.05–0.50% and B: 0.0002–0.0050%, and the balance iron and incidental impurities.

Another preferred steel composition is:
C: 0.10–0.40%; Si: 0.05–1.50%;
Mn: 0.70–2.50%; Cr: 0.10–1.50%,
B: 0.0002–0.0050%;
at least one of Ti: 0.0050–0.050% and Al: 0.007–0.050%, and the balance iron and incidental impurities.

The reason why the steel composition of this invention is preferably defined as in the above will be given below:

Carbon (C) provides the resulting steel wire with requisite levels of strength and hardenability as steel. When carbon is less than 0.10%, it is difficult to acquire a requisite level of strength. On the other hand, when carbon is over 0.40%, ductility and spot-weldability deteriorate so much that the resulting wire cannot be used as a PC steel wire.

Silicon (Si) improves both hardenability and strength. When silicon is less than 0.05%, improvement cannot be expected. When it is over 1.50%, the ductility deteriorates markedly.

In order to improve hardenability, it is necessary to incorporate manganese (Mn) in an amount of not less than 0.70%. However, it is not necessary to add Mn in an amount of more than 2.50%.

Chromium (Cr), like Mn, improves hardenability. It is suitable to add chromium in a proportion of 0.10–1.50%.

Molybdenum (Mo) and/or boron (B), when added together with the alloy elements mentioned above, has a synergistic effect in improving hardenability. The proportion of molybdenum is suitably within the range of 0.05–0.50% and that of boron is within 0.0002–0.0050%. When boron alone is added, at least one of Ti: 0.0050–0.050% and Al: 0.007–0.050% may be added, if necessary. Titanium and/or aluminum is added so as to protect boron against nitrogen. By the addition of titanium and/or aluminum an effective amount of boron is retained, resulting in further improvement in hardenability. Furthermore, titanium itself may improve the hardenability. Titanium in an amount of not less than 0.0050% and/or aluminum in an amount of not less than 0.007% is required so as to protect the boron sufficiently. As long as the usual amount of nitrogen is contained, there is no need to add titanium and aluminum in amount of more than 0.050% and 0.050%, respectively.

The steel rod having the alloy composition mentioned above is easily and satisfactorily transformed to martensite while the finishing cooling is taking place at a slow cooling rate. In addition, the thus obtained scale is desirable for roller die drawing. The cooling rate during finishing cooling is preferably in the range of 1° C./sec–20° C./ sec, more preferably in the range of 5° C./sec–20° C./sec.

EXAMPLES

Working examples for manufacturing a high tensile PC steel wire with a defrormed section will be described.

Steel rods of the compositions shown in Table 1 were respectively hot-rolled and precooled prior to finishing rolling to adjust the inlet temperature of the hot-rolled rod for the finishing rolling to 830° C. The diameter of the rod was reduced to 7.5 mm through the finishing rolling.

The resulting rod was quenched to 650° C. by means of forced water cooling and then was coiled in a ring-shaped form through a laying-type coiler. The coiled wire was then extended and moved along a conveyor of the STELMOR type cooling apparatus at a transporting rate of 0.4 m/sec. While the wire was on the conveyor, it was finish-cooled at a cooling rate of about 10° C./sec by blowing air. The length of the conveyor was 40 m and the cooling time was 100 seconds.

The comparative purposes some of the hot-rolled rods of steels B, C, D, G, H, I, J, L and M were not pre-cooled, but were quenched to temperatures of 850° C. and 650° C. The inlet temperature of such rods for finishing rolling was 950° C.

The resulting mechanical properties and the thickness of scale are summarized in Table 2.

TABLE 1

| Steel | C | Si | Mn | P | S | Cr | Mo | B | Al | Ti |
|---|---|---|---|---|---|---|---|---|---|---|
| A | 0.10 | 0.49 | 1.51 | 0.021 | 0.018 | 0.75 | 0.25 | — | — | — |
| B | 0.11 | 0.50 | 1.49 | 0.024 | 0.016 | 0.74 | 0.01 | 0.0025 | — | — |
| C | 0.20 | 0.60 | 1.60 | 0.021 | 0.017 | 0.70 | 0.24 | — | — | — |
| D | 0.21 | 0.58 | 1.61 | 0.018 | 0.018 | 0.72 | 0.01 | 0.0029 | — | — |
| E | 0.20 | 0.32 | 1.95 | 0.021 | 0.019 | 0.45 | 0.01 | 0.0030 | — | — |
| F | 0.22 | 0.50 | 2.01 | 0.019 | 0.020 | 0.46 | 0.28 | — | — | — |
| G | 0.30 | 0.55 | 1.49 | 0.020 | 0.018 | 0.69 | 0.24 | — | — | — |
| H | 0.31 | 0.56 | 1.51 | 0.020 | 0.016 | 0.72 | 0.01 | 0.0025 | — | — |
| I | 0.11 | 0.50 | 1.49 | 0.024 | 0.016 | 0.74 | — | 0.0025 | 0.035 | 0.030 |
| J | 0.21 | 0.58 | 1.61 | 0.018 | 0.018 | 0.72 | — | 0.0029 | 0.033 | 0.029 |
| K | 0.20 | 0.32 | 1.95 | 0.021 | 0.019 | 0.45 | — | 0.0028 | 0.040 | 0.035 |
| L | 0.21 | 0.55 | 1.65 | 0.020 | 0.019 | 0.72 | — | 0.0025 | 0.050 | 0.001 |
| M | 0.31 | 0.56 | 1.51 | 0.020 | 0.016 | 0.75 | — | 0.0022 | 0.035 | 0.034 |

TABLE 2

| Steel | Category | Inlet Temp. (°C.) | Tensile strength (kg/mm²) average* | Tensile strength (kg/mm²) scatter* | Drawing ratio (%) average* | Drawing ratio (%) scatter* | Thickness of scale (μ) |
|---|---|---|---|---|---|---|---|
| A | I | 830 | 116 | 6.0 | 58 | 5 | 0.9 |
| B | I | 830 | 115 | 5.5 | 59 | 6 | 0.9 |
| | II | 950 | 114 | 6.8 | 58 | 10 | 1.0 |
| | III | 950 | 85 | 16.0 | 56 | 15 | 9.0 |
| C | I | 830 | 149 | 4.5 | 58 | 5 | 1.1 |
| | II | 950 | 149 | 5.0 | 55 | 9 | 1.1 |
| | III | 950 | 121 | 21.0 | 57 | 18 | 9.5 |
| D | I | 830 | 152 | 4.0 | 55 | 5 | 0.7 |
| | II | 950 | 150 | 6.1 | 52 | 11 | 0.8 |
| | III | 950 | 118. | 18.0 | 50 | 20 | 10.0 |
| E | I | 830 | 153 | 4.2 | 53 | 4.5 | 0.9 |
| F | I | 830 | 157 | 4.5 | 55 | 5.0 | 0.8 |
| G | I | 830 | 166 | 4.0 | 50 | 5.5 | 0.9 |
| | II | 950 | 165 | 5.5 | 47 | 9.0 | 1.1 |
| | III | 950 | 128 | 32.0 | 45 | 15.0 | 11.0 |
| H | I | 830 | 163 | 4.5 | 51 | 5.0 | 0.9 |
| | II | 950 | 163 | 5.0 | 46 | 9.5 | 0.9 |
| | III | 950 | 125 | 28.0 | 45 | 16 | 10.0 |
| I | I | 830 | 116 | 5.4 | 59 | 6.0 | 0.9 |
| | II | 950 | 114 | 6.9 | 57 | 9.0 | 0.9 |
| | III | 950 | 83 | 16.5 | 55 | 16.0 | 9.5 |
| J | I | 830 | 149 | 4.6 | 58 | 4.5 | 0.9 |
| | II | 950 | 148 | 5.1 | 56 | 7.5 | 0.8 |
| | III | 950 | 120 | 22.0 | 57 | 16 | 9.0 |
| K | I | 830 | 154 | 4.3 | 54 | 4.5 | 0.9 |
| L | I | 830 | 153 | 4.0 | 55 | 55 | 0.8 |
| | II | 950 | 151 | 6.2 | 53 | 11.0 | 0.9 |
| | III | 950 | 171 | 18.5 | 51 | 22.0 | 10.0 |
| M | I | 830 | 168 | 4.5 | 51 | 5.5 | 0.9 |
| | II | 950 | 166 | 6.0 | 48 | 9.5 | 1.0 |
| | III | 950 | 127 | 31.0 | 44 | 14.0 | 10.0 |

NOTE:
(1) Category I this invention
Category II comparative example (no-pre-cooling, quenched to 650° C.)
Category III comparative examples (no-pre-cooling, quenched to 850° C.)
(2) *Average and scatter of 50 pieces of specimens.

As is apparent from the data shown in Table 2 above, the scatter was small with respect to tensile strength and drawing ratio, when the pre-cooling was applied in accordance with this invention. The thickness of scale is also small. However, in the comparative examples, the scatter of the results was large. In particular, in the case where the inlet temperature was 950° C., the thickness of scale was rather large. This means that the pre-cooling is critical for obtaining satisfactory results.

The thus obtained hot-rolled rods were subjected to roller die drawing with a two-set tandem type drawing apparatus. The diameter of the rod was reduced from 7.5 mm to 7.28 mm during drawing. The drawing speed was 90 m/min. No lubricant was used and, further, no descaling was effected prior to the drawing. The test results on the drawing performance are summarized in Table 3.

TABLE 3

| Steel | Category* | Drawing Performance |
|---|---|---|
| A | I | good |
| B | I | good |
| | III | bad (galling occurred) |
| C | I | good |
| | III | bad (galling occurred) |
| D | I | good |
| | III | bad (galling occurred) |
| E | I | good |
| F | I | good |
| G | I | good |
| | III | bad (galling occurred) |
| H | I | good |
| | III | bad (galling occurred) |
| I | I | good |
| | II | good |
| | III | bad (galling occurred) |
| J | I | good |
| | II | good |
| | III | bad (galling occurred) |
| K | I | good |
| L | I | good |
| | II | good |
| | III | bad (galling occurred) |
| M | I | good |
| | II | good |
| | III | bad (galling occurred) |

NOTE:
*the same as in Table 2

Deforming was applied to the wires obtained in the preceding examples in accordance with this invention to give an oval shape in section. After deforming, the wire was heated to 450° C. by high-frequency heating (250 KW, 3 KHz) and then tempered. Straightening was also applied during tempering so as to adjust the curve of wire to not larger than 6 mm/1.5 m with a spinner-type straightening machine provided 5 meters drawnstream from the outlet of the high frequency heating coil. The inlet temperature of the straightening machine was 440° C.

Thus, from the roller die drawing to the above-mentioned warm straightening, the wire was continuously processed at a feeding speed of 90 m/min. The mechanical properties obtained after warm straightening are summarized in Table 4.

The relaxation is defined by the value obtained by dividing the difference between the initial stress applied to the wire (104 kg/mm$^2$) and the stress remaining after 23 hours by the initial stress. The relaxation value is expressed by percentage.

TABLE 4

| Steel | Category | Yield point (kg/mm$^2$) | Tensile strength (kg/mm$^2$) | Elongation (%) Average | Elongation (%) Scatter | Relaxation* | Bending (mm/1.5 m) |
|---|---|---|---|---|---|---|---|
| A | I | 100 | 110 | 13.0 | 2.0 | 8.5 | 2.4 |
| B | I | 102 | 111.5 | 13.0 | 1.5 | 8.6 | 2.0 |
| | II | 101 | 112 | 12.0 | 3.0 | 8.6 | 2.0 |
| C | I | 139 | 153 | 11.5 | 2.0 | 6.7 | 2.1 |
| | II | 138 | 152 | 10.0 | 3.5 | 6.8 | 2.1 |
| D | I | 140 | 152 | 11.5 | 1.5 | 6.9 | 2.0 |
| | II | 139 | 151 | 10.3 | 3.8 | 7.0 | 1.8 |
| E | I | 139 | 149 | 12.0 | 2.0 | 7.0 | 2.0 |
| F | I | 141 | 154 | 12.3 | 2.1 | 6.8 | 1.8 |
| G | I | 143 | 160 | 11.0 | 2.2 | 6.0 | 3.0 |
| | II | 142 | 159 | 9.8 | 4.0 | 6.0 | 3.4 |
| H | I | 143 | 162 | 11.0 | 2.0 | 5.8 | 3.0 |
| | II | 143 | 161 | 9.9 | 4.2 | 5.9 | 2.9 |
| I | I | 103 | 111.0 | 12.8 | 1.5 | 8.5 | 2.0 |
| | II | 100 | 112 | 12.0 | 3.0 | 8.7 | 2.0 |
| J | I | 141 | 153 | 11.5 | 1.5 | 6.8 | 2.0 |
| | II | 138 | 150 | 10.3 | 4.0 | 7.0 | 1.8 |
| K | I | 138 | 153 | 11.0 | 2.0 | 6.7 | 2.1 |
| L | I | 144 | 161 | 11.5 | 2.5 | 6.2 | 3.0 |
| | II | 142 | 158 | 10.0 | 4.0 | 6.2 | 3.4 |
| M | I | 142 | 162 | 11.0 | 2.0 | 5.8 | 3.0 |
| | II | 141 | 161 | 9.0 | 4.2 | 5.9 | 2.9 |

NOTE:
*The wires were heated to 180° C. for 4 hours, kept thereat for 3 hours, and then cooled gradually over 16 hours. The relaxation value of JIS S35C Steel after quenching and tempering was 16.0%.

As is apparent from the results shown hereinbefore, when pre-cooling is applied prior to finishing rolling in accordance with this invention, it is possible to obtain a hot-rolled rod having fine and uniform grains, which may contribute to improved material properties after the transformation to martensite. In addition, it is always possible to attain a sufficient degree of transformation to martensite. This markedly improves yield of the product.

Since the scale formed under the conditions defined by this invention is very thin, it is possible to effect the wire drawing with roller dies without descaling.

It is also possible to obtain a wire having improved mechanical properties and relaxation properties by applying tempering and warm straightening to the wire after roller die drawing.

Furthermore, it is to be noted that this invention does not require the quenching which is usually required to effect transformation to martensite.

Thus, according to this invention, a simplified and continuous process for manufacturing a PC wire can be provided.

What is claimed is:

1. A Process for manufacturing a high tensile steel wire, characterized by comprising the steps of:

pre-cooling a hot-rolled steel rod to a temperature between 750°–900° C. by means of a cooling apparatus provided between a group of intermediate rolling mills and a group of finishing rolling mills in a hot rolling line for steel rod;

finishing rolling the thus pre-cooled steel rod;

quenching the hot-rolled steel rod to a temperature of 700° C. or lower to provide supercooled austenite;

then finish-cooling the thus quenched rod to provide a martensitic structure;

drawing the resulting steel rod with roller dies without descaling to form a wire; and warm straightening the resulting steel wire to produce a steel wire having a tensile strength of at least 110 kgf/mm$^2$.

2. A process for manufacturing a high tensile steel wire as defined in claim 1, in which the hot-rolled steel rod after finishing rolling is quenched to a temperature between 700°–500° C.

3. A process for manufacturing a high tensile steel wire as defined in claim 1, in which the finish-cooling is carried out by blowing air onto the wire.

4. A process for manufacturing a high tensile steel wire as defined in claim 3, in which the cooling rate of the finish-cooling is 1° C./sec–20° C./sec.

5. A process for manufacturing a high tensile steel wire as defined in any of preceding claims 1–4, in which the steel wire comprises:

C: 0.10–0.40%; Si: 0.05–1.50%;

Mn: 0.70–2.50%; Cr: 0.10–1.50%;

at least one of Mo: 0.05–0.50% and B: 0.0002–0.0050%, and the balance iron and incidental impurities.

6. A process for manufacturing a high tensile steel wire as defined in any of preceding claims 1–4, in which the steel wire comprises:

C: 0.10–0.40%; Si: 0.05–1.50%;

Mn: 0.70–2.50%; Cr: 0.10–1.50%;

B: 0.0002–0.0050%;

at least one of Ti: 0.0050–0.050% and Al: 0.007–0.050%, and the balance iron and incidental impurities.

7. A process for manufacturing a high tensile steel wire as defined in claim 5, in which deforming is applied to the steel wire after drawing with roller dies and before warm straightening.

8. A process for manufacturing a high tensile steel wire as defined in claim 6, in which deforming is applied to the steel wire after drawing with roller dies and before warm straightening.

* * * * *